United States Patent [19]

Nestor et al.

[11] 4,240,523

[45] Dec. 23, 1980

[54] MOTORIZED CRANKCASE OIL CHANGING SYSTEM

[76] Inventors: Jack Nestor, 110 1st Ter., San Marino Is., Miami Beach, Fla. 33139; Raymond Zager, 946 Eve St., Delray Beach, Fla. 33444

[21] Appl. No.: 68,907

[22] Filed: Aug. 23, 1979

[51] Int. Cl.[3] ..... F01M 11/04

[52] U.S. Cl. ..... 184/1.5; 184/105 R; 200/42 T; 200/334; 251/98; 251/107; 417/317

[58] Field of Search ..... 141/98, 1; 417/317; 251/98, 107; 200/42 T, 322, 334; 184/1.5, 105 R

[56] References Cited

U.S. PATENT DOCUMENTS

| | | | |
|---|---|---|---|
| 1,914,896 | 6/1933 | Pelouch et al. | 417/317 |
| 2,178,396 | 10/1939 | Landenberger | 417/317 |
| 3,720,287 | 3/1973 | Martel | 184/1.5 |
| 3,954,250 | 5/1976 | Grace | 184/1.5 |

FOREIGN PATENT DOCUMENTS

| | | | |
|---|---|---|---|
| 306302 | 2/1929 | United Kingdom | 417/317 |

*Primary Examiner*—Houston S. Bell, Jr.
*Attorney, Agent, or Firm*—Erwin M. Barnett

[57] ABSTRACT

A reversible fluid pump is driven by a reversible electric motor under the control of a three position toggle switch wired for off, forward and reverse. One port of the pump is connected to a four position valve, one position of which is off. A hose to a drain receptacle or to an oil supply connects to the other port of the pump and hoses from engine crankcases connect to the three active ports of the valve. A two position valve adapts the pump for single engine use. The handle for selectively positioning each of the valves extends perpendicularly to the valve stem and when in off position aligns with the toggle. Safety latches of alternate constructions, with or without thumb screw tightening means, are each pivoted to the handle to engage the toggle and retain both the valve and toggle in off position when the system is not in use.

16 Claims, 9 Drawing Figures

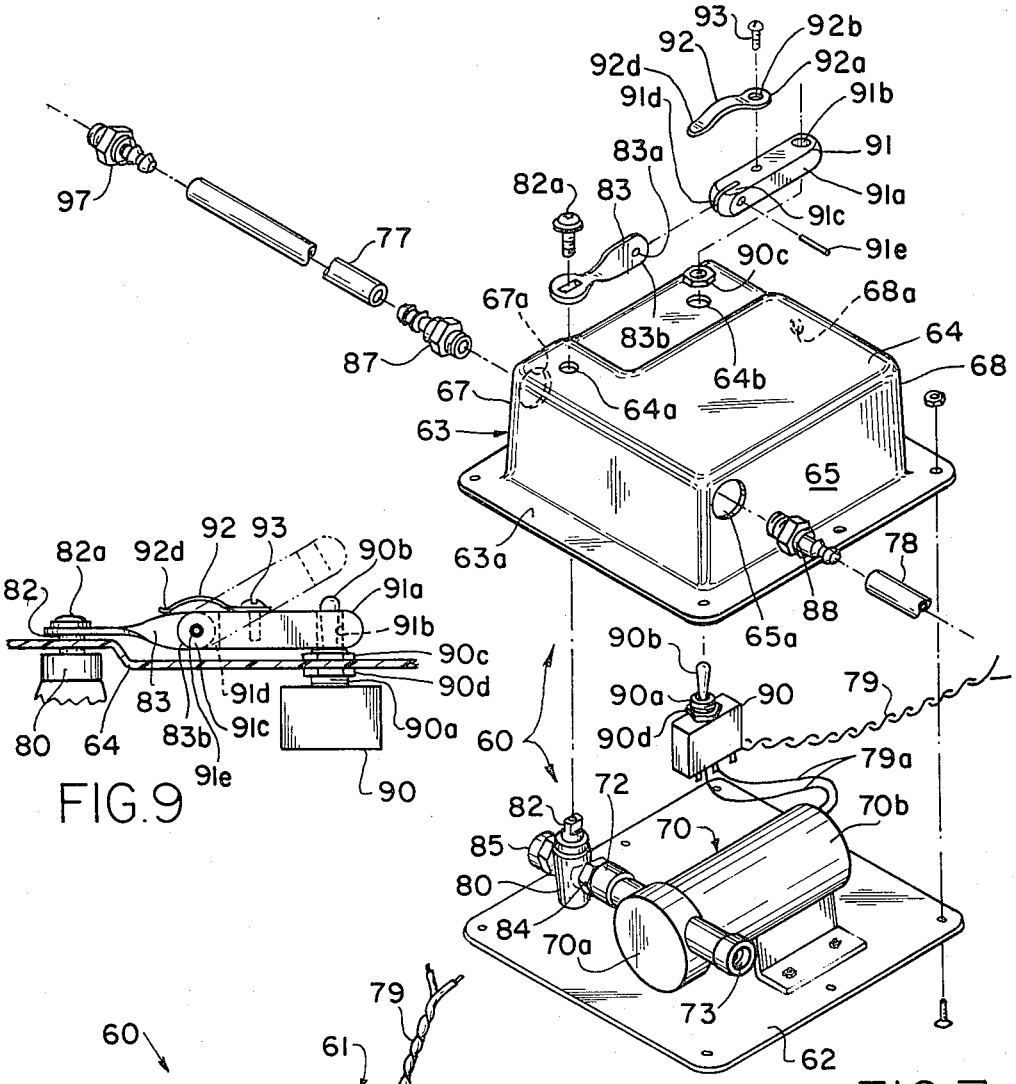
FIG.7
FIG.9
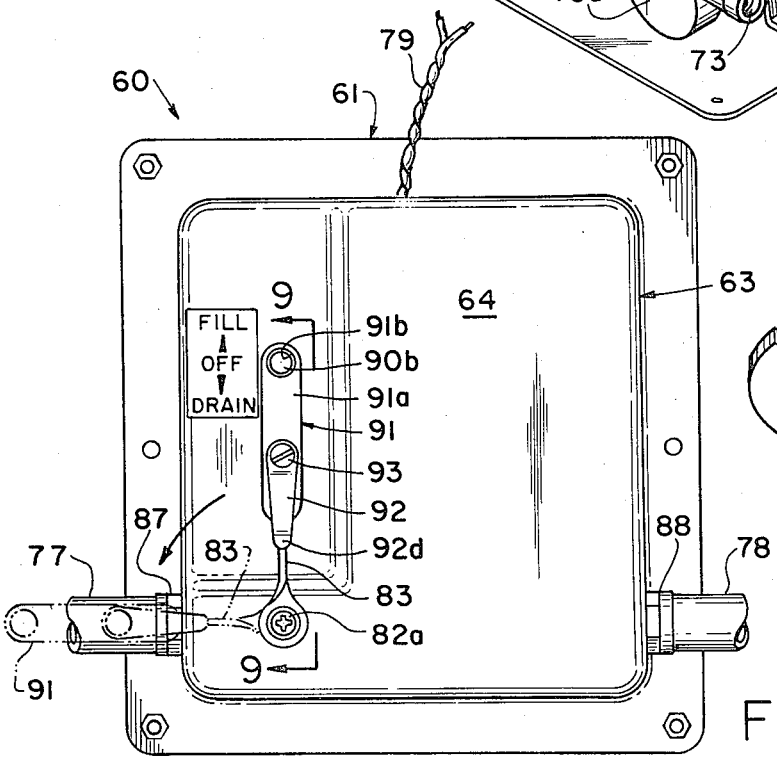
FIG.8
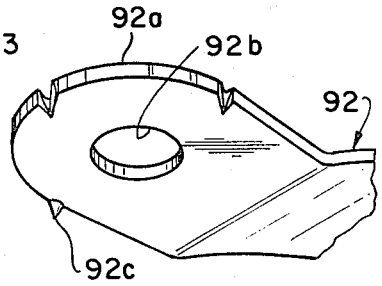
FIG.9A

MOTORIZED CRANKCASE OIL CHANGING SYSTEM

BACKGROUND OF THE INVENTION

1. Field of the Invention

This invention relates to engine maintenance equipment and more particularly to a motorized system for draining and refilling crankcase oil and maintaining the oil at operating levels for use as a permanent installation in twin engine boats and, in simplified form, in automobile and trucks, and having safety lock capability for the controls.

2. Description of the Prior Art

Changing the crankcase oil in boats having inboard engines presents difficulty because of tight quarters and the inaccessibility of the crankcase oil drains often requiring boat owners to employ high cost maintenance personnel having special equipment to change the oil. While electric motor driven pumps powered by storage batteries and adapted to accomplish a wide variety of jobs are well known in the art, there is a present need for a simple, practical and efficient device, not presently available, to alleviate boat owners of the messy, tedious and often expensive chore of changing crankcase oil and maintaining proper oil levels between oil changes.

Various devices have been suggested for aiding the automobile and truck owner in oil changing including dashboard mounted controls for operating special drain plug valves to obviate getting beneath the vehicle to remove the drain plug and various pump arrangements used in connection with such valves for removing the oil. However, there appears to be a need for a simple battery powered motor driven pump having all the controls including a safety lock in a self-contained unit which will be easy to install under the hood as a permanent accessory to enable the individual owner to effectively and efficiently handle the old and the new oil.

SUMMARY OF THE INVENTION

Among the objects of the invention is to satisfy the hereinbefore mentioned needs by providing a device to include at low cost an electric battery powered pump and controls housed in a compact unit with hoses and fittings connecting the unit to the crankcases and to drain and oil supply receptacles, which shall be easy for owners to install as a permanent system in existing twin inboard engine boats or in automobiles and trucks, which shall be dependable and efficient to operate, and except for interchanging one of the hoses between disposal and supply receptacles, shall be controlled by the simple positioning of a valve and electric toggle switch, both conveniently located on the unit housing, and which shall incorporate an effective safety lock for the controls to prevent accidental operation of the pump by personnel moving about the engine compartment of the boat or by inadvertence when making repairs or adjustments under the hood. The system shall fill the crankcases directly through the drain openings thereby reducing the chances for transient dust or dirt getting into the oil or engines and, there being no waiting for the new oil to drain into the crankcases, time is saved and accuracy assured by providing instant dipstick checking for oil level both in refilling and in adding oil to maintain proper levels.

BRIEF DESCRIPTION OF THE DRAWINGS

FIG. 7 is an exploded perspective view of a central oil change unit, connecting hoses and fittings similar to FIG. 2, but for a simplified system for single engine use.

FIG. 8 is a top plan view of the unit shown in FIG. 7 with the valve handle and the toggle in off positions and showing a modified safety latch with a spring assist in locked position, the valve handle and safety latch being indicated in broken lines in open valve position.

FIG. 9 is a side view of the modified safety latch as seen from line 9—9 in FIG. 8, the latch being indicated in broken lines in open position, and FIG. 9A is an enlarged fragmentary bottom perspective view of the anchored end of the leaf spring shown in FIGS. 8 and 9 removed from the assembly showing the integral spikes for retaining the spring in operative alignment on the latch bar.

DESCRIPTION OF THE PREFERRED EMBODIMENTS

Figure 2:
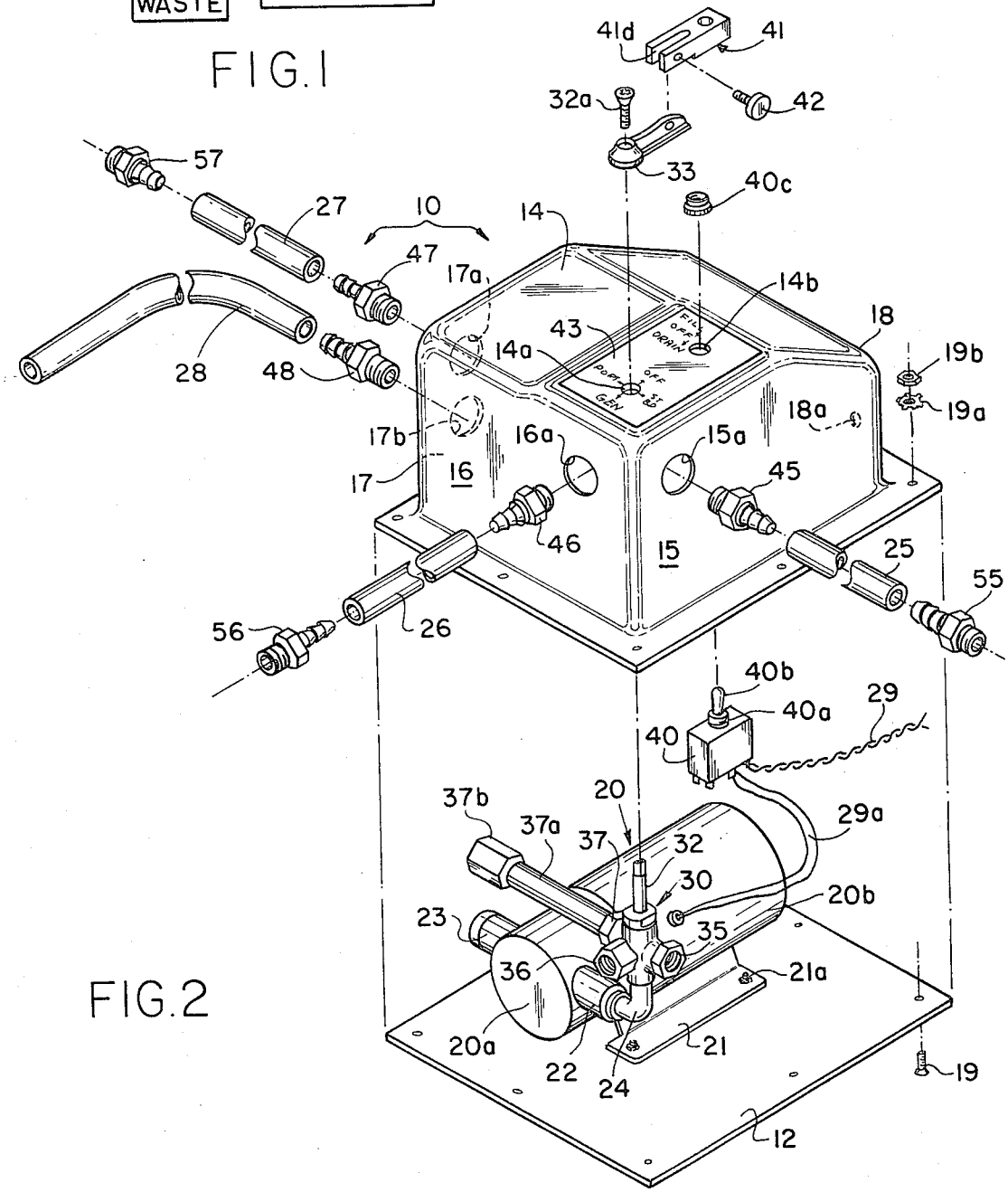
FIG. 2 is an exploded perspective view of the central oil change unit, connecting hoses and fittings comprising the system for multiple engine use and embodying the invention.
Figure 3:
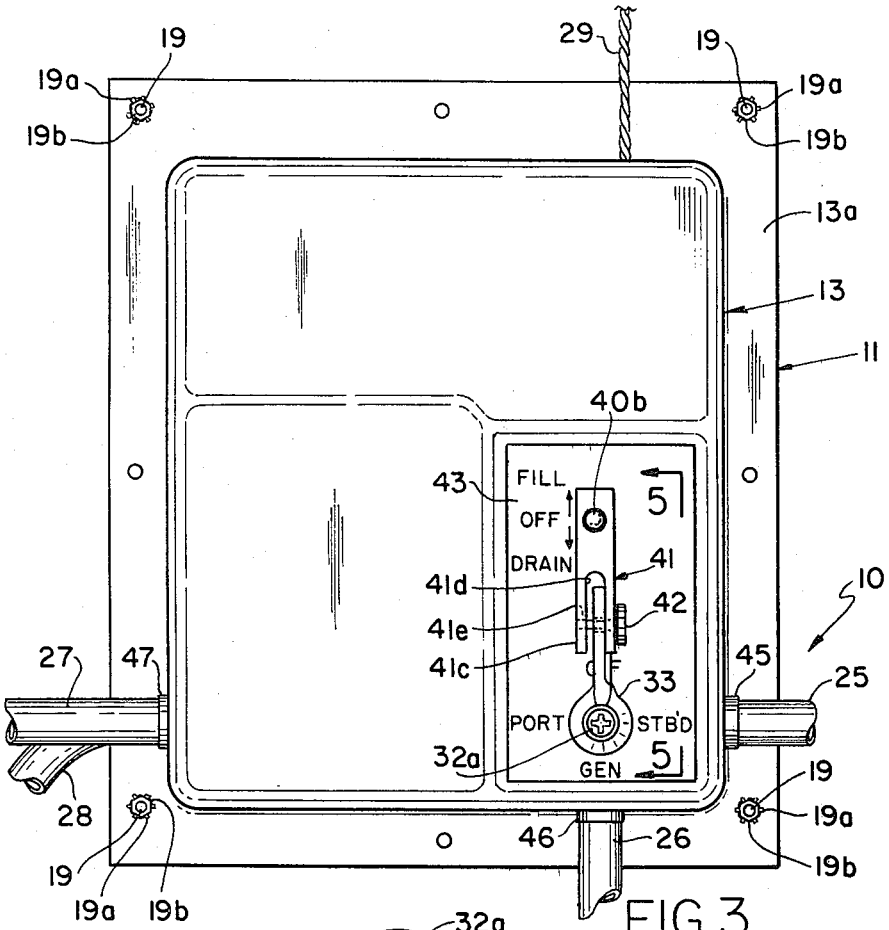
FIG. 3 is a top plan view of the unit shown in FIG. 2 with the valve handle and the toggle both in off positions and showing the safety latch with a thumb screw tightening means in locked position.

Referring in detail to the drawings, 10 generally denotes a motorized oil draining and refilling system, constructed to embody the invention, seen in FIGS. 2 and 3 as a central unit 11 which houses electric motor driven pump unit 20, four position selector valve 30 and three position electric toggle switch 40, and to which electric wiring 29 and four hoses, herein designated starboard engine hose 25, generator hose 26, port engine hose 27 and drain/refill hose 28, are connected.

Electric motor driven pump unit 20 is supported in the usual manner by a pair of feet 21, which may be attached by screw and nut fasteners **21*a* to a flat base supporting plate 12, and comprises a rotary vane pump 20*a* of any suitable conventional construction having a capability for forward and reverse pumping and being driven by a reversible DC motor 20*b* of a 12, 24 or 36 volt rating to correspond to the power source available at the installation. Pump 20*a* is seen in FIG. 2 to provide a pair of horizontally aligned right and left facing ports 22 and 23, respectively, both being internally threaded to respectively engage a horizontally disposed end of externally threaded elbow 24 and threaded coupling 48** of drain/refill hose 28. The vertically disposed end of elbow 24 engages the internally threaded common port 34 of selector valve 30 supporting the latter in a vertically upright position.

Figure 4:
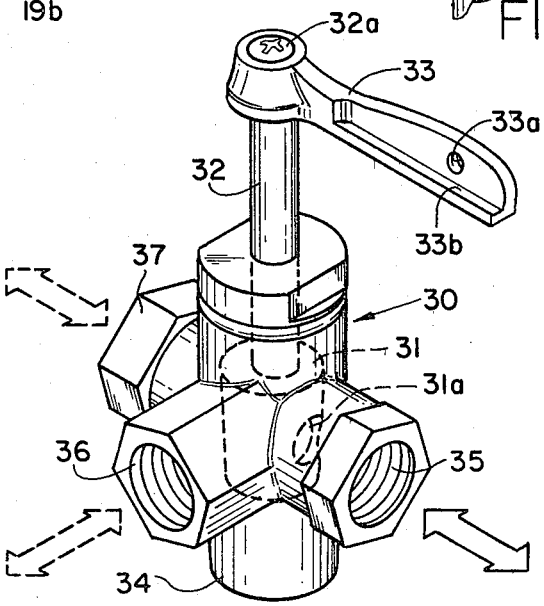
FIG. 4 is an enlarged perspective view of the four position valve removed from the unit, the full line striped arrow indicating the common port, the full line plain arrow indicating the selected path when the handle extends toward the right positioning the valve cylinder as indicated in broken lines, and the two broken line arrows indicating the other two alternative valve settings.

Four position selector valve 30, seen in FIGS. 2 and 4, is of a suitable conventional construction having the common port 34 aligned with the open end and axial bore of valve cylinder 31, the opposite closed end of cylinder 31 mounting axially extending valve stem 32. Three co-planar, internally threaded, ports 35, 36 and 37 are arranged in a T-shaped configuration lying in a plane perpendicular to the axis of common port 34 and valve stem 32. Selector valve 30 is orientated on elbow 24 with respect to the axis of valve stem 32 to face port 35 to the right, port 36 forwardly, and port 37 to the left and in axial horizontal alignment with port 35. As will be clear from FIG. 4, the upper end of valve stem 32 terminates in a handle 33 removably secured by a retaining screw 32*a* and keyed to turn with stem 32 and valve cylinder 31 for selectively positioning opening 31*a* formed in the latter to align with ports 35, 36 or 37, or with a blind wall of the valve opposite port 36 providing an "off", that is a fourth and closed, position for valve 30. Handle 33, being mounted to project radially in alignment above opening 31*a*, indicates the selected position of opening 31*a* by extending in the direction thereof, the position being further specified by a decal 43, as shown in FIG. 3 and hereinafter more fully described. A snap-in indexing means (not shown but well known in the art of selective valves) may be associated with cylinder 31 to insure accurate alignment of the valve in each of its four positions.

To complete the housing which encloses the components of central unit 11, a deep dish-shaped cover 13 is formed with a peripheral flange 13*a* having a contour conforming in size and shape to seat on the peripheral border of base plate 12 for attachment of cover 13 thereto in closed position by a plurality of fasteners, one of which may be located at each of the four corners and comprises a screw 19 extending through aligned openings in plate 12 and flange 13*a*, a lock washer 19*a* and nut 19*b*. Plate 12 and cover 13 may be made of a suitable plastic material, cover 13 being vacuum formed in an appropriate shape to position a right, front portion of top wall 14, to which decal 43 is adhesively attached, just below valve handle 33 and have spaced front and rear openings 14*a* and 14*b* arranged in back to front alignment inwardly of right side wall 15. Front opening 14*a* aligns with valve 30 enabling valve stem 32 to extend therethrough. Rear opening 14*b* is sized to accommodate the threaded neck 40*a* of toggle switch 40 from which toggle 40*b* projects, switch 40 being secured therein by nut 40*c* and orientated so that toggle 40*b* selectively snaps into forwardly and rearwardly inclined positions from a central vertical "off" position, the plane of the toggle movement being co-planar with the front opening 14*a*. Rear opening 14*b* is spaced from front opening 14*a* to provide a predetermined distance from the end of handle 33 when aligned in the direction thereof for the purpose hereinafter described. Right side wall 15 and front side wall 16 of cover 13 are spaced in relative close proximity to right facing port 35 and forwardly facing port 36 of valve 30, respectively. Walls 15 and 16 have openings 15*a* and 16*a* which align with ports 35 and 36 and are sized to accommodate for passing therethrough couplings 45 and 46 of starboard engine hose 25 and generator hose 26, respectively. Likewise, left side wall 17 is in relative close proximity to the left port 23 of pump 20*a* and to an internally threaded connector 37*b* which terminates an extension nipple 37*a* from left facing port 37, wall 17 being formed with an upper opening 17*a* and a lower opening 17*b* which align with connector 37*b* and port 23 and are sized to accommodate couplings 47 and 48 of port engine hose 27 and drain/refill hose 28, respectively. Rear side wall 18 of cover 13 has a small opening 18*a* through which electric wiring 29 extends connecting switch 40 with a DC power source, power from switch 40, in accordance with the setting thereof, being supplied to motor 20*b* by wiring 29*a*.

Figure 6:
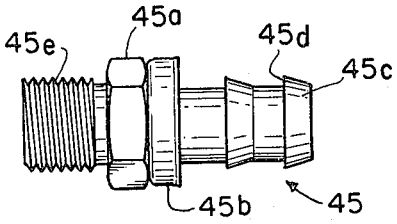
FIG. 6 is an enlarged side elevational view of a hose coupling representative of those shown in FIG. 2.

Hose couplings 45, 46, 47 and 48 and also couplings 55, 56 and 57 which may terminate the ends of hoses 25, 26 and 27 remote from central unit 11 for connecting to the crankcases of the starboard engine, the generator and the port engine, respectively, may be of any well known construction having opposite male member ends extending from a hexagonal midportion for wrench tightening, one end being externally threaded and the other end formed to fit into the bore of the hose which may then be secured thereto by an external clamp. As herein shown, hose couplings 45, 46, 47, 48, 55, 56 and 57 may all be constructed to employ a self-locking hose connection which eliminates the external clamp. FIG. 6 illustrates details of such construction as coupling 45 having a hexagonal midportion 45*a*, a threaded male end 45*e* and an opposite male end, for telescoping into an end of the hose to which it is to be connected, formed with a plurality of rings having outwardly tapered surfaces 45*c*, that is, tapering away from midportion 45*a*, each ring having a radially extending face at the large end of the taper providing an annular edge 45*d* facing midportion 45*a*. An annular flange 45*b* extends from midportion 45*a* toward edges 45*d*. In operation, annular edges 45*d* are sized to have an OD slightly larger than the hose ID, tapered surfaces 45*c* enabling the coupling end to be force fitted into the bore of the hose, which may be suitably lubricated for the purpose, until the free end of the hose engages under annular flange 45*b*. Thereafter, edges 45*d*, in a sense, bite into the wall of the hose and cooperate with flange 45*b* which retains the free end of the hose against stretching to prevent removal of the hose from coupling 45.

The two controls for operating system 10, namely, handle 33 of selector valve 30 and toggle 40*b* of toggle switch 40, are located on the cover top wall 14 of central unit 11 and are in close proximity to each other enabling the use of a simple interconnecting latch bar 41 to serve as a safety lock which simultaneously prevents inadvertent turning of handle 33 from an "off" position to one of the three "on" positions and, what is more important in terms of possible damage to the equipment, the accidental movement of toggle 40*b* from its "off" position to either one of the two "on" positions which energize motor 20*b*.

Figure 5A:
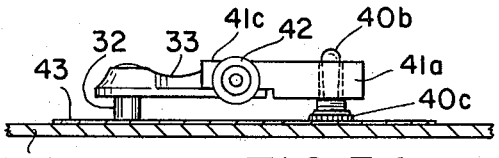
FIG. 5A is a side view of the safety latch as seen from line 5—5 in FIG. 3.
Figure 5B:
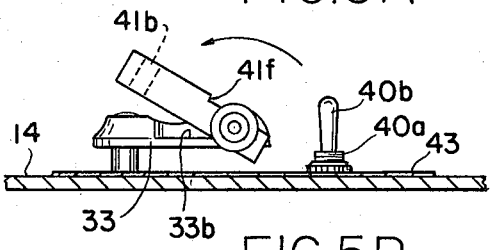
FIG. 5B is a view similar to FIG. 5A but showing the safety latch raised to the open position.

Latch bar 41 is pivotally mounted as an extension of handle 33 to swing from a longitudinally extended locking position shown in FIG. 5A to an upwardly folded open position shown in FIG. 5B. A block portion 41*a* is formed at the free end of latch bar 41 with a transverse passageway 41*b* adapted to engage toggle 40*b* for retention in the vertically extending neutral or "off" position. Passageway 41*b* may taper slightly from a wider bottom end, that is, the end adjacent threaded neck 40*a* when in locking position, to clear toggle 40*b* without movement thereof when latch bar 41 swings to or from open position. The opposite pivoted end portion 41*c* of latch bar 41 is bifurcated by a longitudinally extending centralized slot 41*d* open at one end and of a width to accommodate the vertically upstanding free end portion of handle 33 and permit relative transverse movement of latch bar 41 on thumb screw 42 when the latter is loosened. The bifurcated arms of pivoted end portion 41*c* has a pair of aligned transverse openings 41*e* through which thumb screw 42 extends serving as a pivot pin for bar 41. A threaded opening 33*a* is formed in the end portion of handle 33 which extends into slot 41*d* and is located to axially align between openings 41*e* for adjustable engagement by thumb screw 42. A ledge 33*b* extends longitudinally along a bottom edge of handle 33 projecting from one side thereof. When latch bar 41 is in an extended locking position and thumb screw 42 is pulled up tight as shown in FIGS. 3 and 5A, ledge 33*b* engages the bottom cutout 41*f* of the bifurcated arm of pivoted end portion 41*c* which is adjacent to the head of thumb screw 42. As seen in FIG. 5A, when cutout 41*f* rests on ledge 33*b* and is held in locking position by thumb screw 42, the longitudinally extending bottom of block portion 41*a* likewise rests on neck 40*a* of toggle switch 40 preventing any bending or displacement of valve stem 32 should any excessive downward force be applied to latch bar 41.

Toggle switch 40 is wired in the well understood manner to provide an open circuit to electric motor 20*b* when toggle 40*b* is in the middle position designated "off" on decal 43 as seen in FIG. 3, to drive motor 20*b* and pump 20*a* in a direction whereby port 22 serves as an inlet and port 23 as an outlet when toggle 40*b* is inclined toward front side wall 16 in the designated "drain" position, and to drive motor 20*b* and pump 20*a* in a reverse direction with ports 22 and 23 serving as outlet and inlet, respectively, when toggle 40*b* is inclined toward rear side wall 18 in the designated "fill" position.

Figure 1:
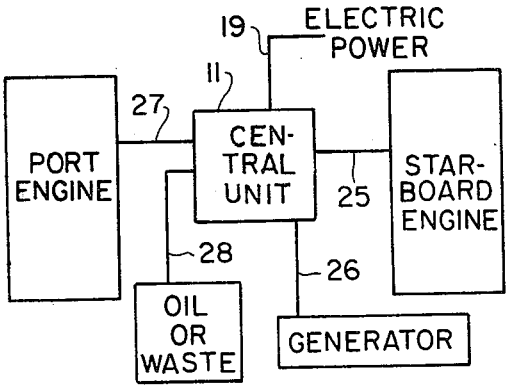
FIG. 1 is a schematic block diagram of the motorized oil draining and refilling system adapted to a twin engine boat in accordance with the invention.

The practical utility and operation of motorized oil draining and refilling system 10 will now be apparent. Central unit 11 is permanently mounted in a convenient location in the engine compartment of the twin engine boat and may be attached by suitable screw fasteners extending through the aligned openings provided in base plate 12 and peripheral flange 13*a* midway between the corners. The crankcase drain plugs of the starboard engine, generator and port engine are replaced by hose couplings 55, 56 and 57, respectively, enabling unit 11 to be connected as indicated in the diagram in FIG. 1, hoses 25, 26 and 27 being permanently attached at both ends and are of lengths for being positioned to extend unobtrusively between unit 11 and the respective crankcases. Wiring 19 is also permanently connected to the power source of the boat. When system 10 is not in use, handle 33 and toggle 40*b* are both locked in "off" positions by latch bar 41, as shown in FIGS. 3 and 5A and hereinbefore described. To release handle 33 and toggle 40*b*, thumb screw 42 is loosened permitting latch bar 41 to be moved laterally along thumb screw 42, that is, towards the right as viewed in FIG. 3, whereby the bifurcated arm of pivoted end portion 41*c* disengages from and clears the longitudinal ledge 33*b* of handle 33 enabling latch bar 41 to pivot upwardly to the position shown in FIG. 5B after passageway 41*b* disengages toggle 40*b*, releasing the latter and handle 33 for operating system 10.

Toggle 40*b* is retained in "off" position except when actually transferring oil. Prior to draining the oil, the free end of drain/refill hose 28 is positioned within a suitable receptacle for collecting the used oil for later disposition. Each crankcase is drained individually by turning handle 33 from the 12 o'clock "off" position to extend, as indicated in FIG. 3 by decal 43, toward 3 o'clock for the starboard engine, toward 6 o'clock for the generator, and 9 o'clock for the port engine. While handle 33 is in each of these positions, toggle 40*b* is moved to the "drain" position to effect the transfer of oil from the respective crankcase to the oil collecting receptacle.

Similarly, with the drain/refill hose 28 transferred to an oil supply receptacle, each crankcase is selected by handle 33 for filling with new oil and toggle 40*b* is moved to the "fill" position to accomplish each transfer. This crankcase filling may be facilitated by premeasuring the new oil into the supply receptacle in accordance with the volume requirements of the respective engines and then transferring the entire measured quantity. Or, the supply receptacle may be provided with easily readable graduations for transferring a desired volume of the new oil under the control of toggle 40*b* in the well understood manner.

A simplified version of system 10, adapted to single engine use for vehicles, such as cars, trucks and buses, is shown in FIGS. 7 and 8 as system 60 comprising central unit 61 housing electric motor driven pump unit 70, two position valve 80 and three position electric toggle switch 90. Electric wiring 79 and two hoses, herein designated engine hose 77 and drain/refill hose 78, connect to central unit 61.

Electric motor driven pump unit 70, being similar to pump unit 20, is suitably fastened to flat base supporting plate 62 and comprises a rotary vane pump 70*a* and reversible DC motor 70*b* having a voltage rating compatible with the power source of the vehicle in which system 60 is to be installed. Pump 70*a* is seen in FIG. 7 to comprise a pair of horizontally aligned left and right facing ports 72 and 73, respectively, both being internally threaded.

Valve 80 is an on/off valve of any conventional construction having an upstanding valve stem 82 terminating at the upper end in a handle 83 removably secured by a retaining screw 82*a* and keyed to turn with stem 82 from a perpendicularly disposed "off" position shown in full lines in FIG. 8 to an "on" position at 90° thereto indicated in broken lines as extending toward the left and parallel to hose 77. Handle 83 has a vertically extending upstanding free end portion 83*b* formed with an opening 83*a* through which pivot pin 91*e* extends as a pivotal attachment for latch bar 91. Valve 80 has oppositely facing coaxial ports 84 and 85, port 84 being externally threaded to engage the left facing port 72 of pump 70*a*, port 85 being internally threaded for receiving therein the male threaded end of coupling 87 which terminates engine hose 77.

Central unit 61 has a deep dish-shaped cover 63 formed with a peripheral flange 63*a* for seating on base plate 62 and may be secured in position by suitable fasteners in the same manner as cover 13 of central unit 11. Top wall 64 of cover 63 is formed with spaced front and rear openings 64*a* and 64*b* arranged in a manner similar to openings 14*a* and 14*b* of cover 13 but located adjacent left side wall 67. Front opening 64*a* aligns with valve stem 82 which extends therethrough and rear opening 64*b* mounts toggle switch 90 with threaded neck 90*a* extending therethrough and secured by nuts 90*c* and 90*d* engaging opposite sides of top wall 64 to properly orientate toggle 90*b* for selective forward and rearward movement in the plane of openings 64*a* and 64*b*.

Right side wall 65 and left side wall 67 of cover 63 are spaced in relative close proximity to right facing port 73 of pump 70*a* and left facing port 85 of valve 80, respectively. Opening 65*a* of wall 65 and opening 67*a* of wall 67 align with ports 73 and 85 and are sized to accommodate for passing therethrough couplings 88 and 87 of drain/refill hose 78 and engine hose 77, respectively. Rear side wall 68 has opening 68*a* through which electric wiring 79 extends connecting switch 90 with a DC power source in the vehicle for energizing motor 70*b* through wiring 79*a* in accordance with the setting of toggle 90*b*.

Hose coupling 97, which terminates the end of engine hose 77 remote from central unit 61 for connecting to the drain plug opening of the vehicle crankcase, and couplings 87 and 88 may be of any well known construction similar to couplings 45, 46, 47, 48, 55, 56 and 57 of system 10 and preferably of the type shown in FIG. 6.

Handle 83 is seen to be of a simplified construction as compared to handle 33 and carries a latch bar 91 as an extension for engaging toggle 90*b* and thereby serving as a safety means locking both valve 80 and toggle switch 90 in "off" position in a manner similar to latch bar 41 but being resiliently retained in position engaging toggle 90*b* as an alternative to the locking of latch bar 41 by thumb screw 42. Latch bar 91 is seen in FIGS. 7, 8 and 9 to be formed at the free end thereof in a block portion 91*a* having a transverse passageway 91*b* adapted to engage toggle 90*b*. The opposite pivoted end 91*c* of latch bar 91 is bifurcated by longitudinal centralized slot 91*d* open at one end and of a width to accommodate therein vertical portion 83*b* of handle 83. The arms of bifurcated end portion 91*c* have a pair of aligned transverse openings in which pivot pin 91*e*, herein provided as a roll pin, is seated to extend across slot 91*d* and through the aligned opening 83*a* enabling latch bar 91 to pivot with respect to the vertical portion 83*b* of handle 83 between an axially aligned locking position shown in FIGS. 8 and 9 wherein toggle 90*b* is engaged by transverse passageway 91*b* and an angularly raised position shown in broken lines in FIG. 9 wherein block portion 91*a* is free of toggle 90*b* for rotation of handle 83 and valve stem 82 to an open valve position indicated in broken lines in FIG. 8.

A bowed leaf spring 92 applies a biasing downward force on block portion 91*a* for retaining the latter in a fully locked position against toggle switch neck 90*a* when toggle 90*b* is in "off" position and extends through transverse passageway 91*b* as shown in FIG. 9. Retaining screw 93 extends through opening 92*b* formed in anchored end 92*a* of bowed leaf spring 92 and threads into a suitably drilled and tapped opening in block portion 91*a*. The periphery of anchored end 92*a* is formed with a plurality of spaced spikes 92*c*, as shown in FIG. 9A, which bite into the surface of block portion 91*a* when retaining screw 93 is tightened in assembling the parts and prevent pivoting of leaf spring 92 with respect to latch bar 91. Leaf spring 92 is thus retained in axial alignment with latch bar 91 and handle 83. The opposite free end 92*d* of leaf spring 92 slidingly engages the upper edge of vertical portion 83*b* of handle 83 and applies the downward biasing force on block portion 91*a* against which force the latter is manually raised when engaging or disengaging transverse passageway 91*b* from toggle 90*b* to simultaneously lock or release handle 83 and toggle 90*b*.

Central unit 61 may be mounted as a permanent installation in a convenient and readily accessible location under the hood of the vehicle by suitable brackets (not shown). Wiring 79 is connected to the vehicle battery power supply and coupling 97 is mounted in the oil drain plug opening attaching hose 77 at both ends. Drain/refill hose 78 is cut to a desired length to conveniently reach an oil supplying or oil collecting receptacle which when in use may be place beside the vehicle. Provision may be made for storing drain/refill hose 78 under the hood when not in use but attached to central unit 61. When installed, system 60 will operate in a manner comparable to system 10 as hereinbefore described.

It is contemplated that the arrangement of latch bar 41 with locking thumb screw 42 and latch bar 91 with biasing leaf spring 92 be considered alternative locking means for use in both systems 10 and 60.

The motorized crankcase oil changing systems herein disclosed are seen to achieve the several objects of the invention and to be well adapted to meet conditions of practical use. As various possible embodiments might be made of this invention, and as various changes might be made in the disclosed systems, it is to be understood that all matters herein set forth or shown in the accompanying drawings are to be interpreted as illustrative and not in a limiting sense.

What is claimed is:

1. In a system for draining and refilling the oil of a plurality of crankcases, each having a hose coupling threaded into the crankcase drain opening, a central unit comprising an electric motor driving a reversible pump, a selector valve, and a three position toggle switch having a toggle projecting from a threaded neck and being wired to supply DC power from a source to said electric motor, said wiring providing for a middle, perpendicular, open circuit position for the toggle between oppositely inclined toggle positions for energizing said motor and driving said pump in "forward" or "reverse" directions to selectively "fill" or "drain" one of said crankcases, said pump having a pair of opposite ports, a first of said ports being connected to a drain/refill hose having an opposite end positioned within an oil discharge or an oil supply receptacle, said selector valve having a common port, a plurality of distributive ports, a stem and a perpendicularly extending handle for rotating the stem to a plurality of selective valve positions, said common port being connected to the second of said pump ports, one of said selective valve positions being an "off" position cutting off the flow of oil through the valve, the other of said valve positions communicating the common port with one of said distributive ports, and a plurality of hoses, one connecting each of said distributive ports with one of said crankcase hose couplings enabling oil to be pumped directly from or into the selected crankcase in accordance with the valve and toggle switch selected positions.

2. The system for draining and refilling oil defined in claim 1 in which said handle has a longitudinal axis extending radially from said stem, a housing enclosing said central unit, said housing having a top wall portion serving as a control panel formed with a pair of spaced openings, said valve stem extending through a first of said openings positioning the longitudinal axis of said handle in parallel spaced relation to said top wall portion, said toggle switch threaded neck being secured in the second of said openings with said toggle extending perpendicular to said housing wall portion when in said open circuit position.

3. The system for draining and refilling oil defined in claim 2 in which said selector valve is orientated with respect to said housing to position the longitudinal axis of said handle in alignment with and extending toward said toggle when in said "off" position, and latch means extending between and disengageably interlocking said handle and toggle against movement when in said "off" and open circuit positions, respectively.

4. The system for draining and refilling oil defined in claim 3 in which said latch means comprises a bar pivotally mounted at one end on said valve handle to extend along said handle longitudinal axis when in said interlocking engagement and adapted to swing to an angular disengaged position, said bar having a block portion at the opposite free end formed with a transverse passageway into which said toggle extends in said interlocking engagement.

5. In a system for draining and refilling the oil of a crankcase having a hose coupling threaded into the crankcase drain opening, a central unit comprising an electric motor driving a reversible pump, a selector valve, and a three position toggle switch having a toggle projecting from a threaded neck and being wired to supply DC power from a source to said electric motor, said wiring providing for a middle, perpendicular, open circuit position for the toggle between oppositely inclined toggle positions for energizing said motor and driving said pump in "forward" or "reverse" directions to selectively "fill" or "drain" said crankcase, said pump having a pair of opposite ports, a first of said ports being connected to a drain/refill hose having an opposite end positioned within an oil discharge or an oil supply receptacle, said selector valve having a pair of ports, a stem and a perpendicularly extending handle having a longitudinal axis axtending radially from said stem for rotating the stem between "open" and "closed" positions, one of said valve ports being connected to the second of said pump ports, a hose connecting the other of said valve ports to said crankcase coupling enabling oil to be pumped directly from or into the crankcase when the valve is in said open position in accordance with the toggle switch selected position, a housing enclosing said central unit having a wall portion serving as a control panel formed with a pair of spaced openings, said valve stem extending through a first of said openings positioning the longitudinal axis of said handle in parallel spaced relation to said wall portion, said toggle switch threaded neck being secured in the second of said openings with said toggle extending perpendicular to said housing wall portion when in said open circuit position, said selector valve being orientated with respect to said housing to position the longitudinal axis of said handle in alignment with and extending toward said toggle when in said "closed" position, and latch means extending between and disengageably interlocking said handle and toggle against movement when in said "closed" and open circuit positions, respectively, said latch means including a bar pivotally mounted at one end on said valve handle to extend along said handle longitudinal axis when in said interlocking engagement and adapted to swing to an angular disengaged position, said bar having a block portion at the opposite free end formed with a transverse passageway into which said toggle extends in said interlocking engagement.

6. The system for draining and refilling oil defined in claim 5 in which said latch means includes a thumb screw adapted to lock said bar in said interlocking engagement.

7. The system for draining and refilling oil defined in claim 5 in which said toggle switch neck projects to locate the exposed end thereof a predetermined distance above said housing wall portion, said latch means including a leaf spring adapted to bias said bar into said interlocking engagement position resting on said toggle switch neck.

8. A unit comprising an electric motor driving a reversible pump, a selector valve connected to one side of said pump, and a three position toggle switch having a toggle projecting from a threaded neck and being wired to supply DC power from a source to said electric motor, said wiring providing for a middle, perpendicular, open circuit position for the toggle between oppositely inclined toggle positions for energizing said motor and driving said pump in "forward" or "reverse" directions, said selector valve having a stem and a perpendicularly extending handle having a longitudinal axis extending radially from said stem for rotating the stem between "open" and "closed" valve positions, a housing enclosing said unit having a wall portion serving as a control panel formed with a pair of spaced openings, said valve stem extending through a first of said openings positioning the longitudinal axis of said handle in parallel spaced relation to said wall portion, said toggle switch threaded neck being secured in the second of said openings with said toggle extending perpendicular to said housing wall portion when in said open circuit position, said selector valve being orientated with respect to said housing to position the longitudinal axis of said handle in alignment with and extending toward said toggle when in said "closed" position, and latch means comprising a bar pivotally mounted at one end on said valve handle to extend along said handle longitudinal axis and engageably interlock said handle and toggle against movement when in said "closed" and open circuit positions, respectively, said bar being adapted to swing to an angular disengaged position and having a block portion at the opposite free end formed with a transverse passageway into which said toggle extends in said interlocking engagement.

9. The unit defined in claim 8 in which said latch means includes a thumb screw adapted to lock said bar in said interlocking engagement.

10. The unit defined in claim 9 in which said valve handle has an upstanding free end portion co-planar with said longitudinal axis and formed with a threaded opening, the pivotally mounted end of said bar being bifurcated into a pair of arms by a longitudinally extending centralized slot into which said handle free end portion extends, said arms having aligned openings located to align with said threaded opening, said thumb screw extending through said aligned openings and engaging said threaded opening as said bar pivotal mounting.

11. The unit defined in claim 10 in which said valve handle is formed with a longitudinal ledge upon which one of said bifurcated arms rests when said bar is in said interlocking engagement between the handle and toggle.

12. The unit defined in claim 11 in which said handle upstanding free end portion and ledge, and said bar centralized slot are sized and proportioned to permit lateral movement of said bar along said thumb screw with respect to said handle enabling said first bifurcated arm to clear said ledge for pivoting of the bar from said interlocking engagement to said angular disengaged position when the thumb screw is loosened.

13. The unit defined in claim 12 in which said toggle switch neck projects to locate the exposed end thereof a predetermined distance above said housing wall portion, a bottom side of said bar being shaped to simultaneously rest on said handle ledge and exposed end of said toggle neck when the bar is in said interlocking engagement to avoid accidental stress on said valve stem.

14. The unit defined in claim 8 in which said toggle switch neck projects to locate the exposed end thereof a predetermined distance above said housing wall portion, said latch means including a leaf spring adapted to bias said bar into said interlocking engagement position resting on said toggle switch neck.

15. The unit defined in claim 14 in which said leaf spring has an end anchored to said bar by a retaining screw and extends parallel to said handle longitudinal axis, said spring having an opposite free end slidingly engaging said handle to exert said bias and permit manual displacement of said bar to said angular disengaged position.

16. The unit defined in claim 15 in which said leaf spring anchored end is formed with a plurality of spikes biting into said bar to prevent displacement of said spring from said position parallel to the handle longitudinal axis.

* * * * *